US006390780B1

(12) United States Patent
Batchelder et al.

(10) Patent No.: US 6,390,780 B1
(45) **Date of Patent: *May 21, 2002**

(54) PUMP AND CONTROLLER SYSTEM AND METHOD

(75) Inventors: Scott K. Batchelder, Newbury; Richard J. Hauss, Groveland; James T. Burrill, Gloucester, all of MA (US)

(73) Assignee: Rule Industries, Inc., Gloucester, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,909

(22) Filed: Sep. 24, 1998

(51) Int. Cl.[7] ..... F04B 49/00; F04B 49/04; F04B 17/00

(52) U.S. Cl. ..... 417/36; 417/17; 417/18; 417/40; 417/423.3

(58) Field of Search ..... 417/36, 17, 18, 417/40, 423.3

(56) References Cited

U.S. PATENT DOCUMENTS

| | | | | |
|---|---|---|---|---|
| 2,260,312 A | * | 10/1941 | Gruman | 417/36 |
| 2,687,693 A | * | 8/1954 | Hudson | 417/18 |
| 3,715,539 A | * | 2/1973 | Silberg et al. | 200/84 C |
| 3,717,420 A | | 2/1973 | Rachocki | |
| 4,171,932 A | | 10/1979 | Miller | |
| 4,205,237 A | | 5/1980 | Miller | |
| 4,265,262 A | | 5/1981 | Hotine | |
| 4,275,995 A | * | 6/1981 | Taylor | 417/40 |
| 4,678,403 A | | 7/1987 | Rudy et al. | |
| 4,766,329 A | | 8/1988 | Santiago | |
| 4,805,668 A | * | 2/1989 | Genter et al. | 137/558 |
| 4,841,404 A | | 6/1989 | Marshall et al. | |
| 5,076,763 A | | 12/1991 | Anastos et al. | |
| 5,078,577 A | | 1/1992 | Heckman | |
| 5,216,288 A | * | 6/1993 | Greene | 417/36 |
| 5,234,319 A | | 8/1993 | Wilder | |
| 5,238,369 A | * | 8/1993 | Far | 417/18 |
| 5,297,939 A | * | 3/1994 | Orth et al. | 417/40 |
| 5,324,170 A | | 6/1994 | Anastos et al. | |
| 5,545,012 A | | 8/1996 | Anastos et al. | |
| 5,562,423 A | | 10/1996 | Orth et al. | |
| 5,577,890 A | * | 11/1996 | Nielsen et al. | 417/44.2 |
| 5,672,050 A | * | 9/1997 | Webber et al. | 417/18 |
| 5,833,437 A | | 11/1998 | Kurth et al. | 417/423.3 |

OTHER PUBLICATIONS

"Whale 3000 Submersible Electric Bilge Pump", 1991.
PCT International Search Report.

* cited by examiner

*Primary Examiner*—Charles G. Freay
*Assistant Examiner*—Michael K. Gray
(74) *Attorney, Agent, or Firm*—Dickstein Shapiro Morin & Oshinsky LLP

(57) ABSTRACT

A liquid pump and controller with separate pump activation and deactivation mechanisms that are both closed detector devices is provided. The pump activation mechanism includes a float device that activates a pump motor when water within a housing of the pump reaches a high water level. The pump deactivation mechanism includes a sensor that detects the load on the pump motor and deactivates it when the sensed load indicates that the water within the pump housing has reached a low water level.

40 Claims, 11 Drawing Sheets

PUMP AND CONTROLLER SYSTEM AND METHOD

BACKGROUND

This invention relates to the field of pumps and, in particular, to liquid level maintaining pumps with automatic activation and deactivation arrangements.

Liquid pumps, such as bilge and sump pumps, are employed in liquid level maintaining systems, frequently as safety equipment in many structures, such as in watercraft and homes. Pumps in liquid level maintaining systems may also be used in other applications, such as maintaining liquid levels in tanks or reservoirs between predetermined minimum and maximum levels. The bilge and sump pump systems generally try to keep the water level inside the structure to a minimum to lesson or eliminate damage to the structure by the water. Some known systems utilize a water level detecting apparatus to activate and deactivate the pump motor. When the detecting apparatus determines that the water level has reached a predetermined maximum level, the pump motor is activated. When the detecting mechanism determines that the water level has dropped below a predetermined minimum level, the pump motor is deactivated. In some systems, the same level is used for both the maximum and minimum.

There are generally two types of liquid level detecting apparatus used in these systems, an "open detector device" and a "closed detector device." The open detector device utilizes the presence of an outside conductive material between two electric terminals to complete an electrical path through the conductive material between the two terminals in order to switch on and off the detecting circuitry of the system. That is, when an external conductive material, such as, for example water, enters the open detector device and comes into electrical contact with the detecting circuitry terminals and completes the electric circuit, the open detector device circuitry causes activation or deactivation of the pump. The detection of the liquid will generally result in activation of the pump, but it could also result in deactivation. Sometimes a combination of three or more terminals are used in the open detection device.

The closed detector device, by contrast, does not require the presence of an outside conductive material to complete an electrical path in order to activate detecting circuitry within the device. That is, all necessary electrical components are included within a closed detector device system.

A bilge pump utilizing a closed detector device is disclosed in U.S. Pat. No. 3,717,420 (Rachocki). The pump disclosed in Rachocki utilizes a float mechanism to detect the water level within a vessel. The float mechanism includes a magnet. As the water level rises, the float rises to a point where the magnetic field of the magnet causes a reed switch to close. When the switch is closed, the pump motor is activated and water is pumped out of the vessel. When the water level drops, the float drops activating a thermostatic delay mechanism. After a delay, the magnetic field is removed from the reed switch, the switch opens and the pump motor is deactivated. One drawback of the bilge pump disclosed in Rachocki is that pump is subject to variation due to the reliance on temperature of the delay mechanism.

A sump pump drive system using a closed detector device is disclosed in U.S. Pat. No. 5,234,319 (Wilder). The sump pump drive system also uses a float to detect water levels. The float is placed in a signal-producing relationship with an analog signal generator. When the water level rises, the float rises and the signal generator causes the pump motor to cycle. This system, however, suffers some drawbacks. That is, since the system uses a single float mechanism to activate and deactivate the pump, the pump motor would undergo cycling due to minor fluctuations in the water level.

U.S. Pat. Nos. 5,562,423 and 5,297,939 (both Orth et al.) refer to an automatic control mechanism for bilge and sump pumps. The automatic control mechanism disclosed in these patents is a closed detector device consisting of a float, a magnet affixed to the float, and a reed switch. A top portion of the chamber encasing the float and magnet is provided with a one-way valve which allows air to exit, but not enter, the chamber. As water enters the lower portion of the chamber, the float and magnet rise and the reed switch is eventually closed. Air exits through the one-way valve, and as the water level drops, a partial vacuum is created above the magnet in the top portion of the chamber. The partial vacuum prevents the magnet from dropping along with the water. When the water level drops below an air inlet contained within the lower portion of the chamber, air enters the chamber and the magnet drops, allowing the motor to be deactivated. One problem is that the automatic control mechanism is only as reliable as the partial vacuum created. Thus, if the vacuum created is insufficient, the magnet will drop along with the water, causing cycling of the pump motor. If the vacuum is too strong, the magnet may not drop, causing continued running of the pump motor.

U.S. Pat. Nos. 5,078,577 (Heckman), 4,678,403 (Rudy et al), 4,171,932 (Miller) and 4,205,237 (Miller) refer to liquid pumps using an open detector device consisting of conductance sensors to detect the water level, and hence, activate or deactivate the pump. The sensors are placed at a high water level. When the water reaches the high water level and comes into contact with the sensors, a conduction path is created between the sensors allowing current sensing circuitry to activate the pump motor. When the water drops below the high water level, the conduction path is removed and the pump is deactivated. There are drawbacks to these systems. These systems rely on sensors that must be immersed in water to operate the pump. The sensors used may become dirty, corroded or even broken, affecting the conductance of the sensors. In addition, the water may contain a material affecting the conductance of the water which could also prevent the pump from being activated.

U.S. Pat. No. 4,265,262 (Hotine) refers to a pump control system for a reservoir tank utilizing an open detector device to detect the level of water in the reservoir. The system uses a pair of conductance sensing probes at a high water level and a pair of conductance sensing probes at a low water level. The reservoir pump is activated when water reaches the pair of conductance sensors located at the high water level and deactivated when the water drops below the pair of conductance sensors located at the low water level. U.S. Pat. No. 4,766,329 (Santiago) also refers to a pump control system utilizing an open detector device to detect high and low water levels. Three probes are arranged in a staggered pattern such that there is one probe at the high water level, a second probe at the low water level and a third probe located below the low water level. When water rises to the high water probe, all three probes are in contact with the water and a conduction path is created which energizes a relay to activate the pump. As the level of the water drops, a conductance path is created between the low water probe and the third probe which energizes a holding circuit to maintain the operation of the pump. When the level of the water drops below the low water probe, the conductance path is removed and the pump is deactivated. These systems, however, like the ones described above, rely on probes that must be immersed in salt water to operate the pump. The probes used may become dirty, corroded or even broken, affecting the conductance of the probes. In addition, the water may contain a material affecting the conductance of the water which could also prevent the pump from being activated.

U.S. Pat. Nos. 5,076,763, 5,324,170 and 5,545,012 (all to Anastos et al.) refer to closed detector devices using a timer and an electrical condition sensor to activate and deactivate a bilge pump motor. At predetermined intervals, the timer sends a signal to activate the pump motor. Once activated, the condition sensor ascertains the load on the motor, which is an indicator of the amount of physical resistance being experienced at the pump's impellers due to the presence or absence of water. If the presence of water is detected, the pump remains on to pump out the water. However, if the presence of water is not detected, the pump is shut off. The '012 patent includes the use of a periodic duty cycle generator, which includes a timer and a generator. The timer actuates the generator at a predetermined cycle, and the generator sends a signal to the motor to operate at a fraction of its full power (so the motor will be less noisy). Once activated, the condition sensor ascertains the load on the motor as described above. U.S. Pat. No. 4,841,404 (Marshall et al.) also uses a load sensor to deactivate an operating pump. These pumps, however, have some drawbacks. First, in order to sense the load on the motor, the motor must be turned on. The cycling of the motor creates noise, which may not be desirable, particularly at night. In addition, the use of timers to activate the pump may be less efficient than a mechanism which acts upon sensed information to maintain the water level, since a timer cannot take into account a change in condition such as, for example, a massive influx of water.

The aforementioned detection mechanisms utilize different "detection criteria" to determine activation and deactivation water levels. These criteria include, but are not limited to sensing the load on an operating motor, detecting the level of a water using a float to trigger a reed switch and sensing a conductance path through water.

There is a need and desire for a liquid pump that utilizes water level detection mechanisms to activate and deactivate the pump that will lessen cycling of the pump motor. The liquid pump detection mechanisms should also withstand the extreme environment of a vessel's bilge and, in particular, the corrosion problems attributable to water. The liquid pump detection mechanisms should sense the level of the water residing in a vessel's bilge to take into account a change in water condition such as, for example, a massive influx of water.

SUMMARY

The disadvantages of the prior art are overcome to a great extent by the present invention, which in one embodiment provides a pump with separate pump activation and deactivation mechanisms that are both closed detector devices. The pump activation mechanism includes a float device that activates the pump motor when water within the pump housing reaches a high water level. The pump deactivation mechanism includes a sensor that detects the load on the pump motor and deactivates it when the sensed load indicates that the water within the pump housing has reached a low water level.

In another aspect of the invention, a pump with separate activation and deactivation mechanism is provided. The activation and deactivation mechanisms use different detecting criteria to determine activation and deactivation water levels.

In another aspect, a control circuit for a liquid pump includes an activation circuit and a pump deactivation circuit. The circuits are coupled to a trigger circuit which operates an activation switch for the pump. The activation circuit generates an activation signal when the liquid reaches the first level and the pump deactivation circuit generates a deactivation signal when the liquid reaches a second level. The trigger circuit closes and opens the activation switch to activate and deactivate the pump responsive to the activation and deactivation signals.

In yet another aspect of the invention, a floating apparatus for detecting a level of water includes a float assembly and a float compartment. The float compartment includes an inner surface and is slightly larger than the float assembly. The float assembly is disposed within said inner surface. The compartment contains a first wall with an opening to allow liquid to enter the compartment and the float assembly rises with a level of the liquid and is guided by the inner surface.

In yet another aspect of the invention, a method of controlling a pump adapted to pump liquid comprises: providing a first closed detector device, said first closed detector device determining when the liquid has reached the first level; activating the pump when the first closed detector device indicates that the liquid has reached the first level; providing a second closed detector device, said second closed detector device determining when the liquid has reached a second level by sensing an electrical condition of the activated pump; and deactivating the pump when the second closed detector device has detected an electrical condition indicating that the liquid has dropped to a second level.

In still a further aspect of the invention, a method of controlling a pump adapted to pump liquid comprises: providing a first closed detector device, said first closed detector device determining when the liquid has reached the first level; activating the pump when the first closed detector device indicates that the liquid has reached the first level; providing a second closed detector device, said second closed detector device determining when the liquid has reached a second level; and deactivating the pump when the second closed detector device has detected that the liquid has dropped to a second level.

It is an object of the invention to provide a pump and a controller for a liquid level maintaining system.

It is a further object of the invention to provide a pump and controller for a liquid level maintaining system with an activation mechanism and a separate deactivation mechanism.

It is a further object of the invention to provide a pump and a controller with an activation mechanism and a separate deactivation mechanism using different criteria to detect different water levels.

It is yet another object of the present invention to provide a pump and a controller with separate mechanisms to activate and deactivate the pump that will lessen the cycling of the pump's motor.

It is still another object of the present invention to provide a pump and controller with separate mechanisms to activate and deactivate the pump that will withstand the extreme environment of a vessel's bilge and, in particular, the corrosion problems attributable to water.

It is still a further object of the present invention to provide a pump and controller with separate mechanisms to activate and deactivate the pump that senses the level of the water residing in a vessel's bilge to take into account changes in the water level.

Other objects, features and advantages of the present invention will become apparent from the following detailed description and drawings of preferred embodiments of the present invention.

DETAILED DESCRIPTION OF PREFERRED EMBODIMENTS

Figure 1:
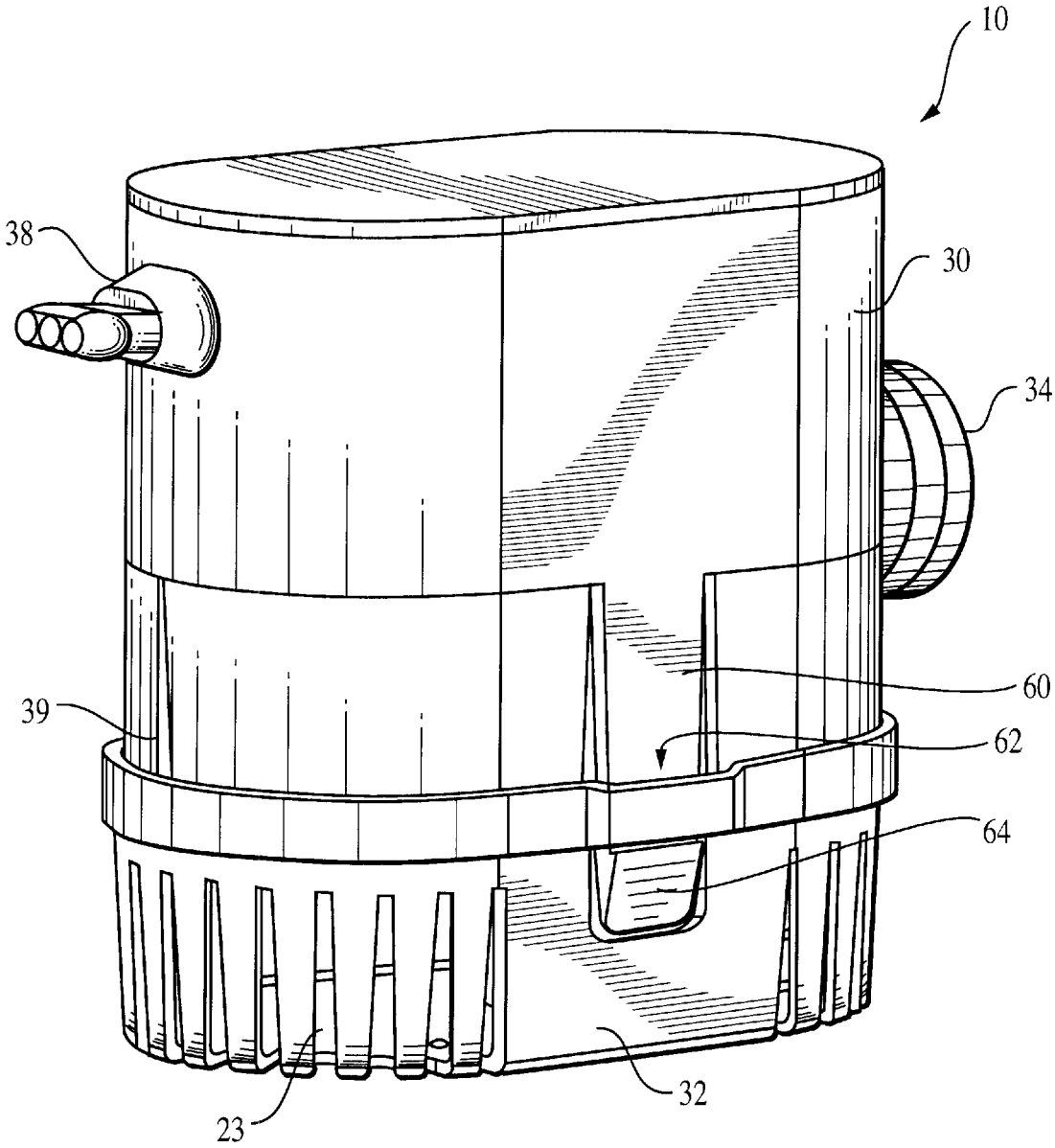
FIG. 1 is a perspective view of a bilge pump constructed in accordance with a first preferred embodiment of the present invention.
Figure 2:
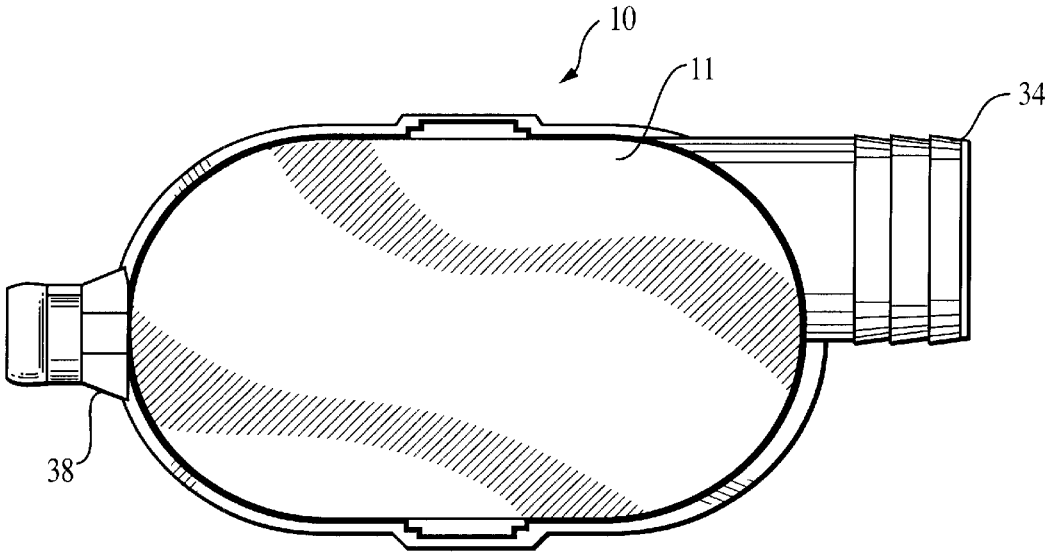
FIG. 2 is a top view of the bilge pump of FIG. 1.

With reference to FIGS. 1–10, a bilge pump 10 is shown according to a preferred embodiment of the present invention. With specific reference to FIG. 8, the bilge pump 10 includes a motor 12 and a float assembly 40 encased within a bilge pump housing 30, and a strainer portion 32 attached to the housing 30. The housing 30 includes a top cap 11 and two housing wall portions 31, 37. The top cap 11 is sealed by welding it to the wall portions 31, 37. Nevertheless, it is to be understood that the top cap 11 may be sealed to the wall portions 31, 37 by another suitable means, or instead may be removably sealed therefrom.

The housing 30 and the strainer portion 32 have an elongated profile. The elongated profile of the housing 30 and strainer portion 32 provides for a compact positioning of the numerous components of the bilge pump 10. Each wall portion 31, 37 of the housing 30 includes a closure tab 60 having an engagement portion 64. The strainer portion 32 includes closure locks 62 to lockingly engage the closure tabs 60 of the housing 30. The housing 30 and the strainer portion 32 are detachably connected by inserting the closure tabs 60 within the closure locks 62 until the engagement portions 64 engage the locks 62.

The motor 12 includes an impeller 14 generally positioned within the strainer portion 32 of the pump 10. The impeller 14 rotates at revolutions sufficient to force water or other liquid out of the pump 10 through a discharge port 34 located on the first wall portion 31 at a position above the strainer portion 32.

The motor 12 is held stationary within the pump housing 30 by a motor housing section 16, which includes an inner housing portion 18 and an outer housing portion 20. The portions 18 and 20 act to prevent liquid from coming into contact with the motor 12. The motor housing section 16 is in connection with and formed as a unit with the first wall portion 31. The motor housing section 16 is further formed as a unit with a printed circuit board housing portion 52 which supports and partially encases a printed circuit board (PCB) 58 having a position sensor switch, such as, for example, a reed switch 42 located thereon (described in greater detail below). While the position sensor switch of the present invention will be discussed as being a reed switch, it is to be understood that other suitable position sensor switches may be used.

A lower segment of the wall portion 31 is in physical connection with a nozzle case 22, which encircles the impeller 14. The nozzle case 22 extends to and is formed as a unit with a float compartment wall 25. Located at a lower portion of the nozzle case 22 in proximity to the impeller 14 is an opening 26 to allow liquid entering the strainer portion 32 to enter the nozzle case 22, so as to be acted upon by the impeller 14.

The strainer portion 32 also includes a protrusion 57 which receives and engages the nozzle case 22 and the lower segment of the first wall portion 31. Specifically, the wall portion 31 includes a groove 63, into which is received a tongue 61 of the nozzle case 22. During assembly, the tongue 61 is positioned in the groove 63 and the nozzle case 22 and float compartment wall 25 are swung up such that the wall 25 contacts the second wall portion 37. After attaching the wall 25 to the float compartment 41 (to be described below), the strainer portion 32 is then snapped onto the lower portion of the pump 10 such that the protrusion 57 covers the tongue 61 and groove 63. This arrangement is used to keep the pressure build-up within the pump 10 from causing damage to the housing 30.

Figure 3:
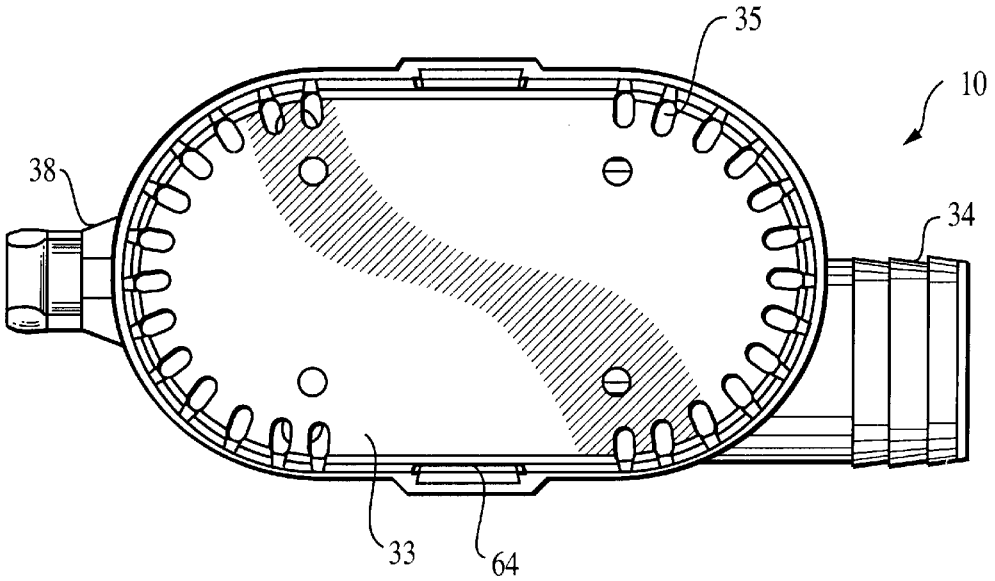
FIG. 3 is a bottom view of the bilge pump of FIG. 1.
Figure 4:
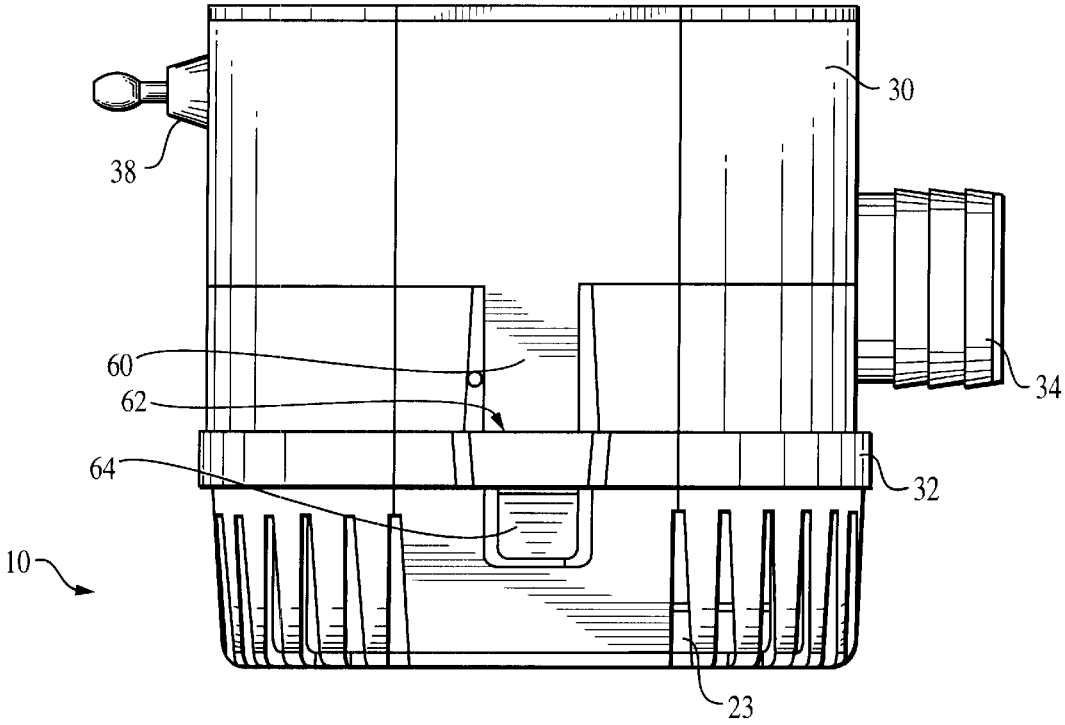
FIG. 4 is a right side view of the bilge pump of FIG. 1.
Figure 5:
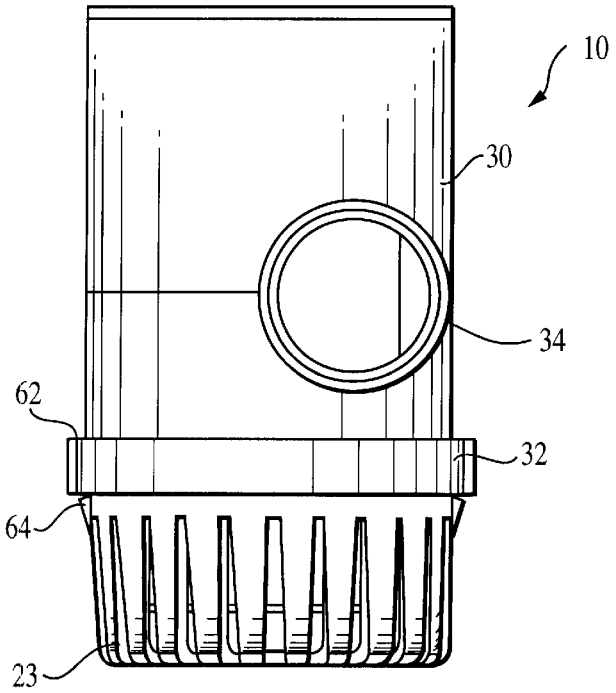
FIG. 5 is a front view of the bilge pump of FIG. 1.
Figure 6:
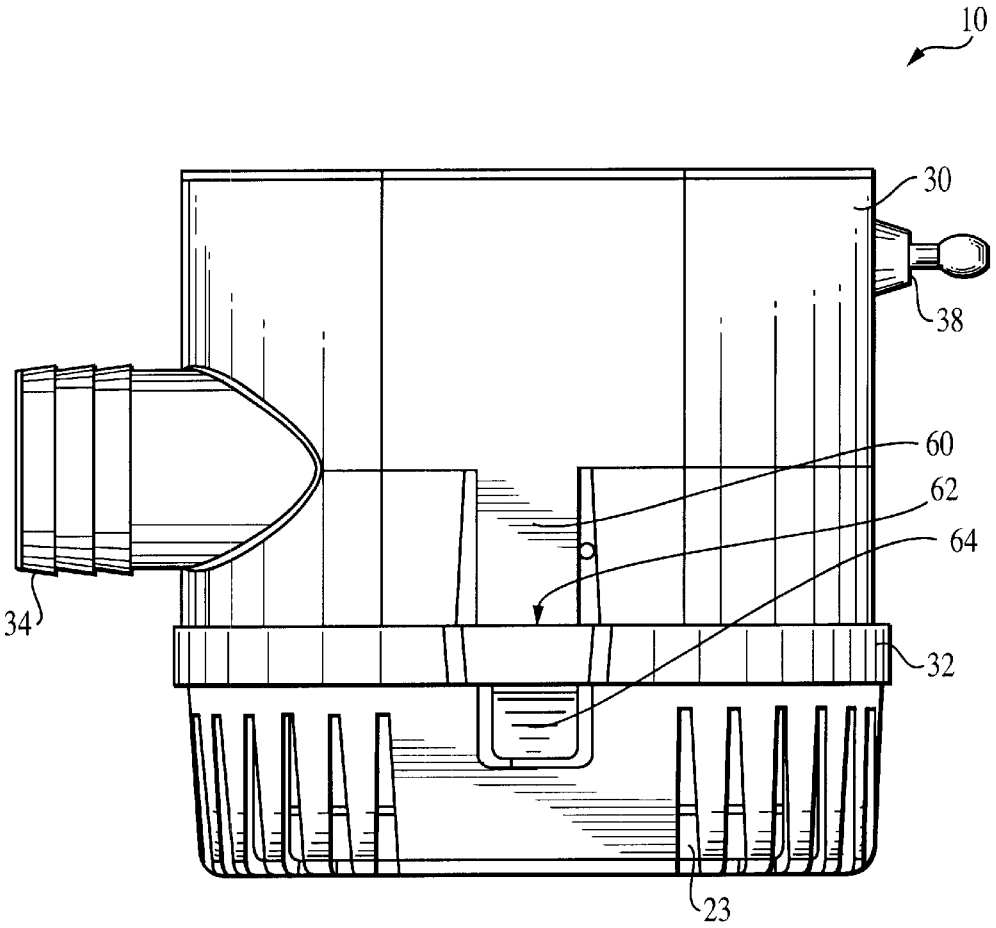
FIG. 6 is a left side view of the bilge pump of FIG. 1.
Figure 7:
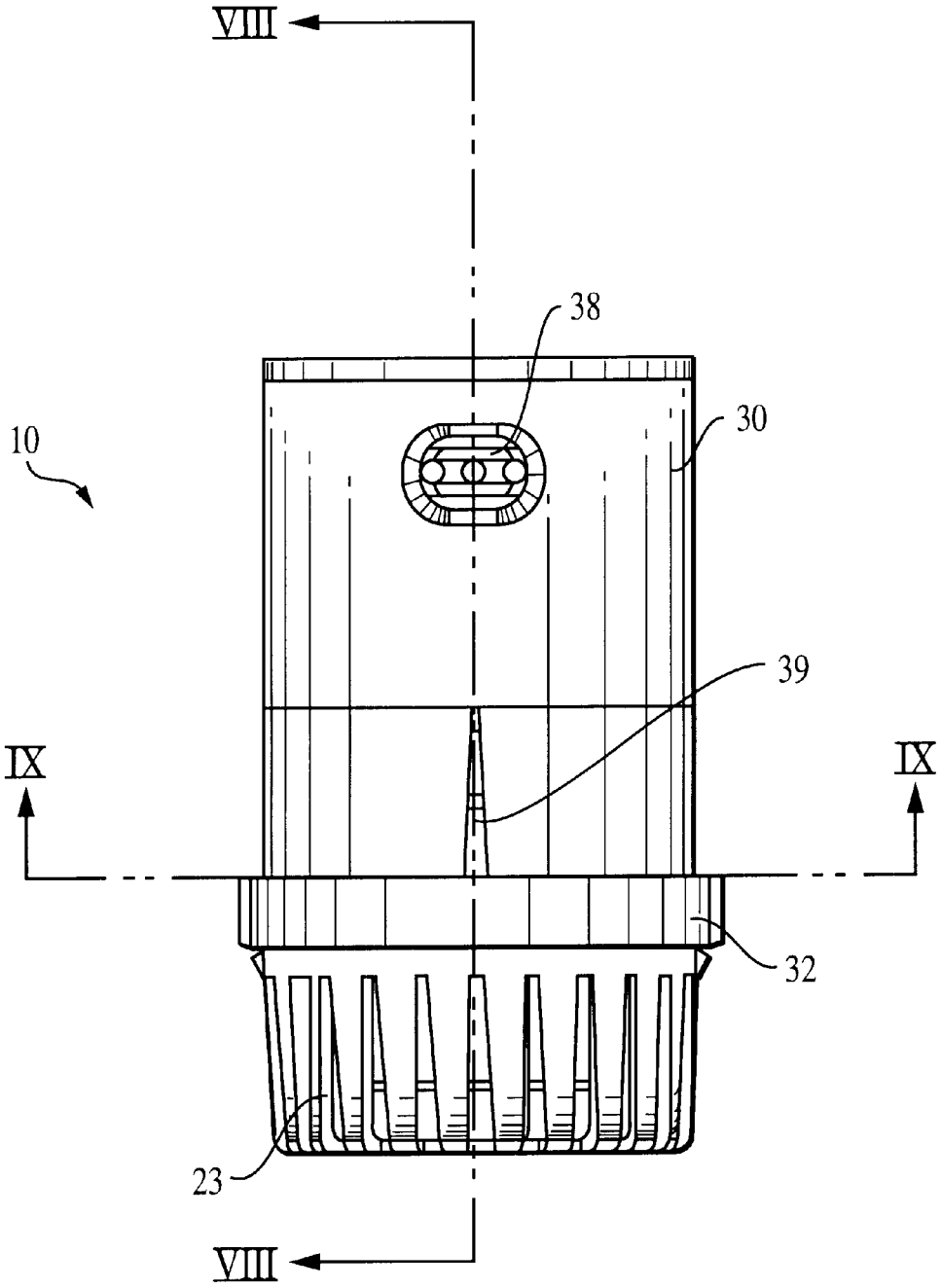
FIG. 7 is a rear view of the bilge pump of FIG. 1.
Figure 8:
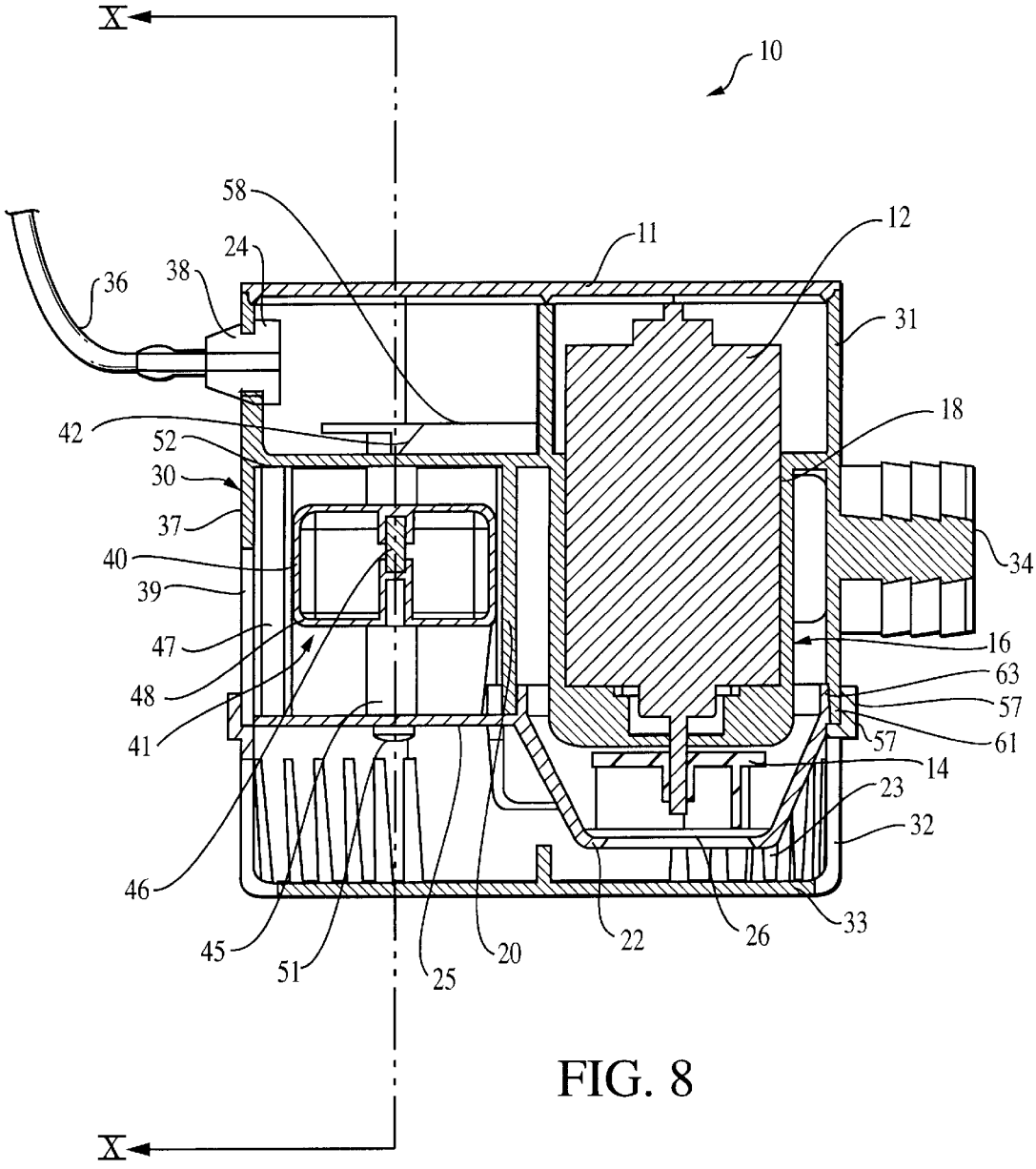
FIG. 8 is a cross-sectional view taken along line VIII—VIII of FIG. 7.
Figure 10:
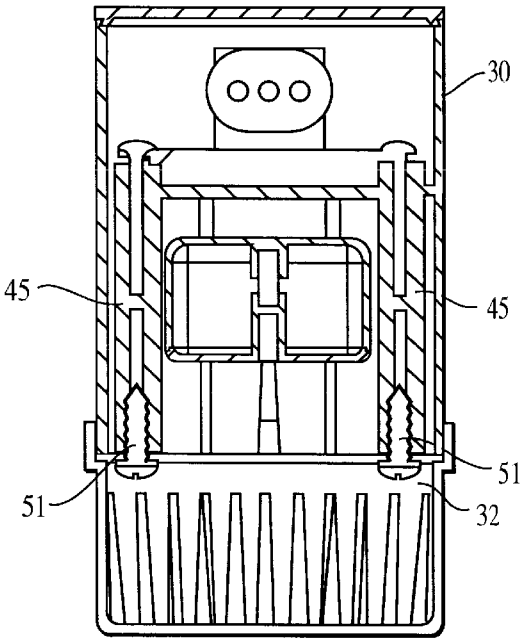
FIG. 10 is a cross-sectional view taken along line X—X of FIG. 8.

The strainer portion 32 includes a plurality of generally vertically aligned openings 23 and a lower portion 33, which itself includes one or more openings 35 (FIG. 3). The openings 23 and 35 allow liquid to enter the strainer portion 32.

The float compartment wall 25 is in physical connection with the outer housing portion 20, and together with the second wall portion 37 form a float compartment 41. The second wall portion 37 has a vertical slot 39. The slot 39 allows liquid to enter the float compartment 41. The float compartment 41 contains a plurality of guidance supports 47 used to guide the float assembly 40 as described in detail below.

The motor 12 is electrically connected to a power source through an electrical connector 36. Preferably, the power source is a 12-volt direct current battery, although other suitable power sources may be utilized. The electrical connector 36 enters the bilge pump housing 30 through an opening 24 in the second wall portion 37. The portion of connector 36 entering the housing 30 is encased within a grommet 38 which partially extends into the printed circuit board housing portion 52. The grommet 38 provides protection to the connector 36 and assists in preventing disconnection of the connector 36 from the PCB 58.

Next will be described the float compartment 41. The float assembly 40 is positioned within the compartment 41 and includes a float housing 48. The assembly 40 has a roughly square-shape. Encased within the float assembly 40 is a magnet 46. Preferably, the magnet 46 is centrally positioned within the float housing 48. The float assembly 40 is formed of materials suitable to make the assembly 40 as a whole less dense than water, such that it is able to float on water.

Figure 9:
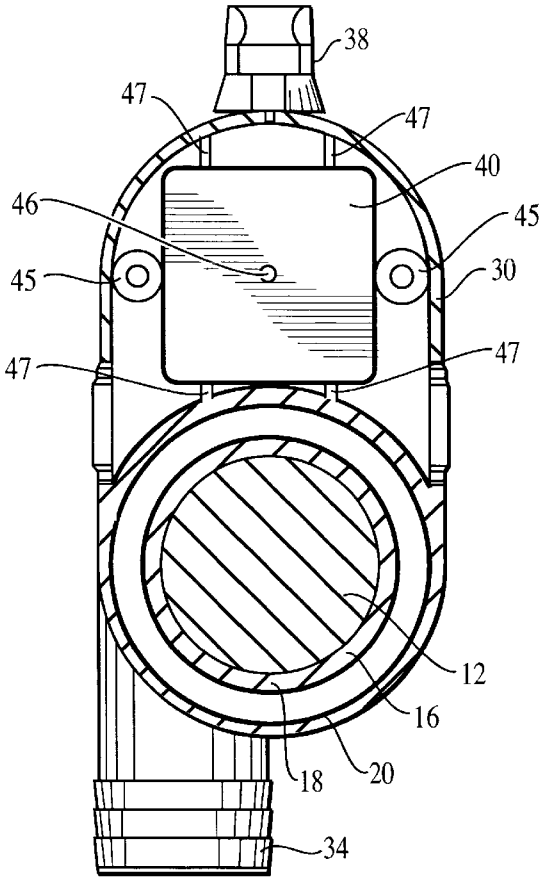
FIG. 9 is a cross-sectional view taken along line IX—IX of FIG. 7.

The plurality of guidance supports 47 extend vertically along the second wall portion 37 and the outer housing portion 20. As shown in FIG. 9, four such supports 47 are positioned within the compartment 41 such that two of the supports 47 are on one side of the float assembly 40 and the other two supports 47 are on a side opposite the first two supports 47. Other spacings and alignments of supports 47 may also be used. The supports 47 assist in aligning the float assembly 40 within the compartment 41 such that the magnet 46 remains aligned with the reed switch 42 residing on the PCB 58 as the water level within the compartment 41 repeatedly rises and falls. In addition, the supports 47 prevent the float assembly 40 from being stuck within the compartment 41 since the supports 47 prevent the assembly 40 from tipping over.

In addition to the guidance supports 47, the compartment includes two circular bases 45 which also assist in aligning the float assembly 40 within the compartment 41. The PCB 58 is attached to the printed circuit board housing 52 and to the float compartment 41 by heat stakes positioned in the bases 45. The float compartment wall 25 is also attached to the float compartment 41 by screws 51 positioned in the bases 45. Screws 51 are inserted into the bases 45 to hold the nozzle case 22 to the compartment 41.

The reed switch 42 is located vertically above the float assembly 40 and is affixed to the PCB 58. The PCB 58 is supported by the printed circuit board housing 52 which is contiguous with the motor housing section 16.

The float assembly 40 and reed switch 42 co-act to engage the motor 12. Water enters the pump 10 through the openings 23 and 35 and the slot 39. Since the float assembly 40 is less dense than water, the assembly 40 will float and will rise with the water as is enters the compartment 41 through the slot 39. As the water level continues to rise, the magnet 46 moves closer to the reed switch 42. The magnet 46 will eventually move close enough to the reed switch 42 such that the switch 42 will co-act with the magnetic forces of the magnet 46 which closes the switch 42. Once closed, the circuitry on the PCB 58 activates the motor 12. A description of the circuitry included on the PCB 58 will be provided below with reference to FIG. 11

The impeller 14 is engaged by the activated motor 12. The rotational speed of the impeller 14 is sufficient to force water resident within the nozzle case 22 to move upwardly and out of the pump 10 through the discharge port 34. The motor 12 and the impeller 14 continue to discharge water out of the discharge port 34 until the motor 12 is deactivated.

Figure 11:
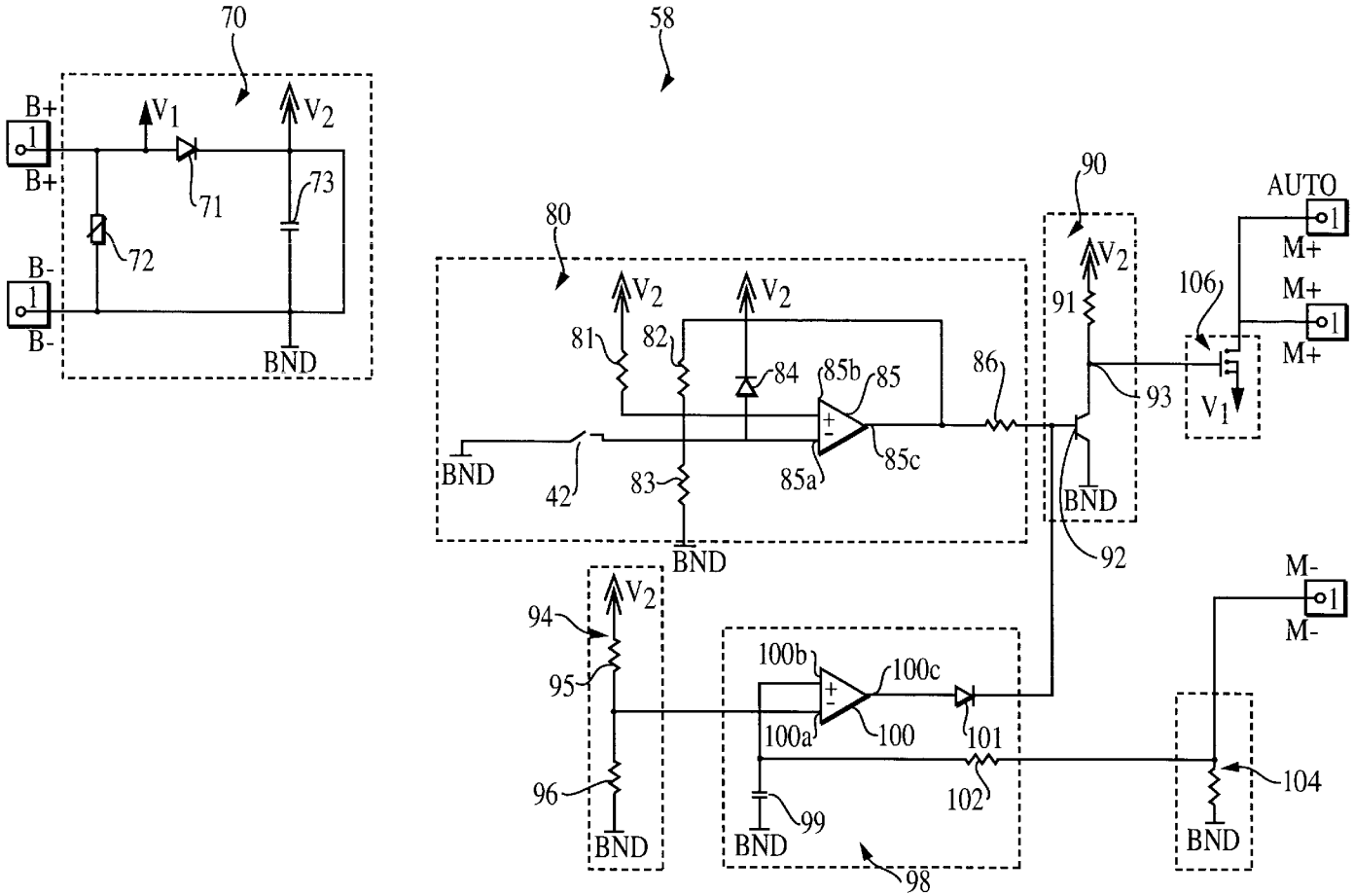
FIG. 11 is a circuit diagram of a preferred embodiment of a pump controller circuit used with the bilge pump of FIG. 1.

FIG. 11 illustrates the circuitry of the PCB 58 which is used to control the activation and deactivation of the motor 10. The circuitry includes a first transistor 106, a pump activation circuit 80, a voltage sensing resistor 104, a pump deactivation circuit 98 and a pump trigger circuit 90.

A power conditioning circuit 70 may also be incorporated into the PCB 58 circuitry to filter out noise and to prevent abnormal power supply voltages such as, for example, an over-voltage condition. The power conditioning voltage output V2 (the second supply voltage V2) would be used to power the circuitry instead of a direct connection to the power supply. Preferably, the power supply is a 12 volt direct current (DC) marine battery. The power conditioning circuit 70 includes a varistor 72, a first diode 71 and a first capacitor 73. The varistor 72 is connected across the terminals of the power supply (e.g., battery). The first diode 71 and the first capacitor 73 are connected in parallel to the varistor 72. The varistor 72 provides over-voltage protection while the first capacitor 73 filters out the high frequency component of any noise. The circuit 70 has two output supply voltages V1 and V2 used to energize the remainder of the PCB's 58 circuitry and the pump motor 12.

The first transistor 106 can be a p-channel metal-oxide-semiconductor field-effect transistor (MOSFET) or any transistor that is activated by a low (or negative) voltage. The first transistor 106 is connected to the positive voltage terminal of the bilge pump motor 12 and serves as a normally open switch until a ground voltage is applied to its gate terminal. Once a ground voltage is applied to the gate terminal of the first transistor 106, the first transistor 106 is energized, that is, the normally open switch is closed, connecting the pump motor 12 to the first supply voltage V1.

The activation circuit 80 generates an activation signal when the water within the pump housing 30 reaches the high water level. The activation circuit 80 includes the reed switch 42, first, second, third and fourth resistors 81, 82, 83, 86, a second diode 84 and a first comparator 85. The reed switch 42 is connected between a ground voltage and a first input 85*a* of the first comparator 85. The second diode 84 is coupled between the second supply voltage V2 and the reed switch 42. The reed switch 42 is normally open and while open, a floating voltage is present at the first input 85*a* of the comparator 85. When the magnet 46 (FIG. 8) moves close enough to the reed switch 42, the switch 42 will co-act with the magnetic forces of the magnet 46 and close, connecting the first input 85*a* of the comparator 85 to ground.

The first resistor 81 is connected between the second supply voltage V2 and a second input 85*b* of the first comparator 85. The second and third resistors 82, 83 are connected between a ground voltage and the output of the first comparator 85 forming a feedback loop to the second input 85*b*. The configuration of the first, second and third resistors 81, 82, 83 provide a reference voltage at the second input 85*b* of the first comparator 85. The reference voltage will be less than the floating voltage at the first input 85*a* when the reed switch 42 is open, but greater than the ground voltage when the reed switch 42 is closed. In operation, the output of the first comparator 85 remains low until the reed switch 42 is closed. When the reed switch 42 is closed, the voltage at the second input 85*b* is greater than the voltage at the first input 85*a* and thus, the output 85*c* of the first comparator 85 goes high. The output 85*c* of the first comparator 85 serves as a pump activation signal which, as will be described below, is used by the trigger circuit 90 to energize the first transistor 106 and activate the pump motor 12. The fourth resistor 86 serves as a limiting resistor which ensures that the output 85*c* is at a proper electrical level for the remainder of the PCB's 58 circuitry.

The voltage sensing resistor 104 is connected to the negative voltage terminal of the bilge pump motor 12. When the pump motor 12 is operating, a current flows through the voltage sensing resistor 104 generating a voltage corresponding to the load on the operating motor 12. As will be discussed below, when the water being pumped is at the high level, the load on the motor 12 increases and, thus, the voltage across the sensing resistor 104 increases. When the water being pumped is at the low water level, the load on the motor 12 decreases and, thus, the voltage across the sensing resistor 104 decreases (hereinafter the "low water voltage").

The pump deactivation circuit 98 is coupled to the voltage sensing resistor 104 and generates a deactivation signal when the water being pumped by the motor is at a low water level. The pump deactivation circuit 98 includes a reference circuit 94, a second comparator 100, a third diode 101, a seventh resistor 102 and a second capacitor 99. The reference circuit 94 includes fifth and sixth resistors 95, 96 connected in series and connected between the second supply voltage V2 and the ground voltage. The series connection of the fifth and sixth resistors 95, 96 is used as the first input 100*a* of the second comparator 100. The values of the resistors 95, 96 are chosen such that a reference voltage equaling the low water voltage is present at the first input 100*a* of the second comparator 100. The reference voltage can be slightly less than the low water voltage to provide a small voltage margin to ensure that the water within the housing 30 is at the low water level.

The second capacitor 99 is connected between the second input 100*b* of the second comparator 100 and the ground voltage. The second input 100*b* is also connected through the seventh resistor 102 to the voltage sensing resistor 104. Thus, the voltage across the sensing resistor 104 is an input into the second comparator 100. The output 100*c* of the second comparator is high while the reference voltage (first input 100*a*) is greater than the voltage across the sensing resistor 104 (second input 100*b*). Once the voltage across the sensing resistor 104 drops below the reference voltage, the output 100*c* of the second comparator 100 goes low (or negative). This low output is used as the pump deactivation signal which is passed through the third diode 101 to the trigger circuit 90. When the trigger circuit 90 receives the pump deactivation signal it turns off the first transistor 106 which deactivates the pump motor 12.

The pump trigger circuit 90 is coupled to the first transistor 106, the pump activation circuit 80 and the pump deactivation circuit 98. The trigger circuit 90 energizes the first transistor 106 and, thus, turns on the pump motor 12 in response to the activation signal. The trigger circuit 90 will turn off the first transistor 106 and, thus, turn off the pump motor 12 in response to the deactivation signal. The trigger circuit 90 includes a second transistor 92 and an eighth resistor 91. The second transistor 92 can be an npn switching transistor which is activated by a high (or positive) voltage. The second transistor 92 and the eighth resistor 91 are connected in series between the second supply voltage V2 and the ground voltage. The series connection is also connected to the gate terminal of the first transistor 106 at a node 93. The node 93 serves as the output of the trigger circuit 90.

The trigger circuit 90 operates as follows. When the activation signal is received from the activation circuit 80, the second transistor 92 is energized. Once energized, the second transistor 92 pulls the voltage present at node 93 to ground. Thus, a low voltage is applied to the first transistor 106 and, since the first transistor 106 is activated by a low voltage, the first transistor 106 becomes energized and activates the pump motor 12. When the deactivation signal is received from the deactivation circuit 98, the second transistor 92 is turned off. It must be noted that the activation signal will not be present at this time since the water has dropped well below a level that would cause the magnet 46 to close the reed switch 42. Once the second transistor 92 is turned off, the voltage across the eighth resistor 91 is present at node 93. This is a high voltage which is applied to the first transistor 106 and, since the first transistor 106 is turned off by a high voltage, the first transistor 106 is turned off. This deactivates the pump motor 12.

The bilge pump 10 of the present invention utilizes a float assembly 40 that activates the pump motor 12 when water within the pump housing 30 reaches a high water level. The pump 10 utilizes a separate deactivation mechanism that includes a sensor 104 to detect the load on the pump motor 12 and deactivates the motor 12 when the sensed load indicates that the water within the housing 30 has reached a low water level. By using a deactivation mechanism that is separate from the activation mechanism, the pump 10 of the present invention prevents excessive cycling of the motor 12. By avoiding the use of conductance sensors that must be immersed in salt water, the bilge pump's 10 activation and deactivation mechanisms can withstand the extreme environment of a vessel's bilge and, in particular, the problems attributable to salt water. In addition, by using a float assembly 40 as the activation mechanism, the bilge pump 10 senses the level of the water residing in a vessel's bilge to take into account sudden changes such as, for example, a massive influx of water.

Figure 12:
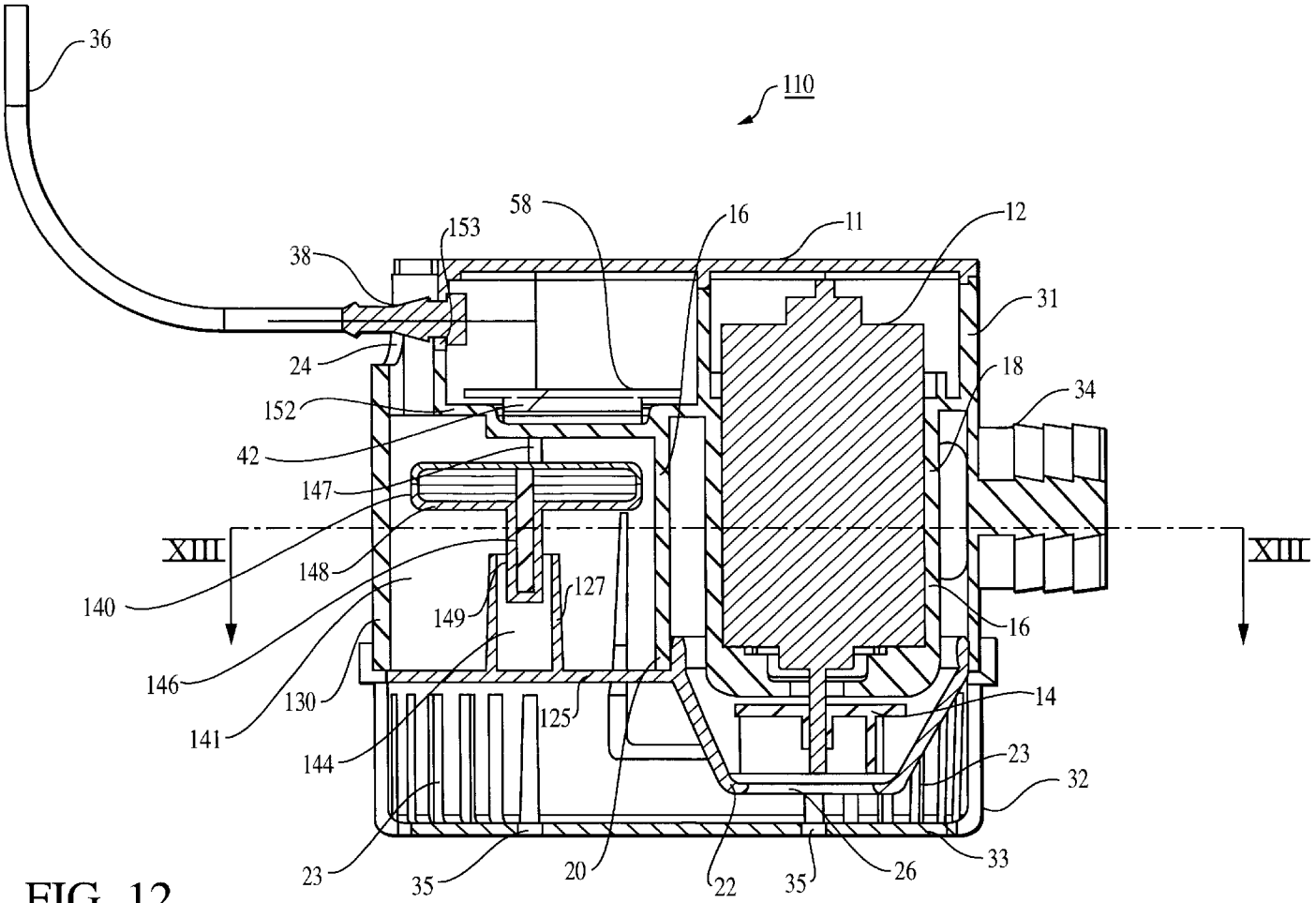
FIG. 12 is a view like FIG. 8 showing an alternate float construction in accordance with the present invention.
Figure 13:
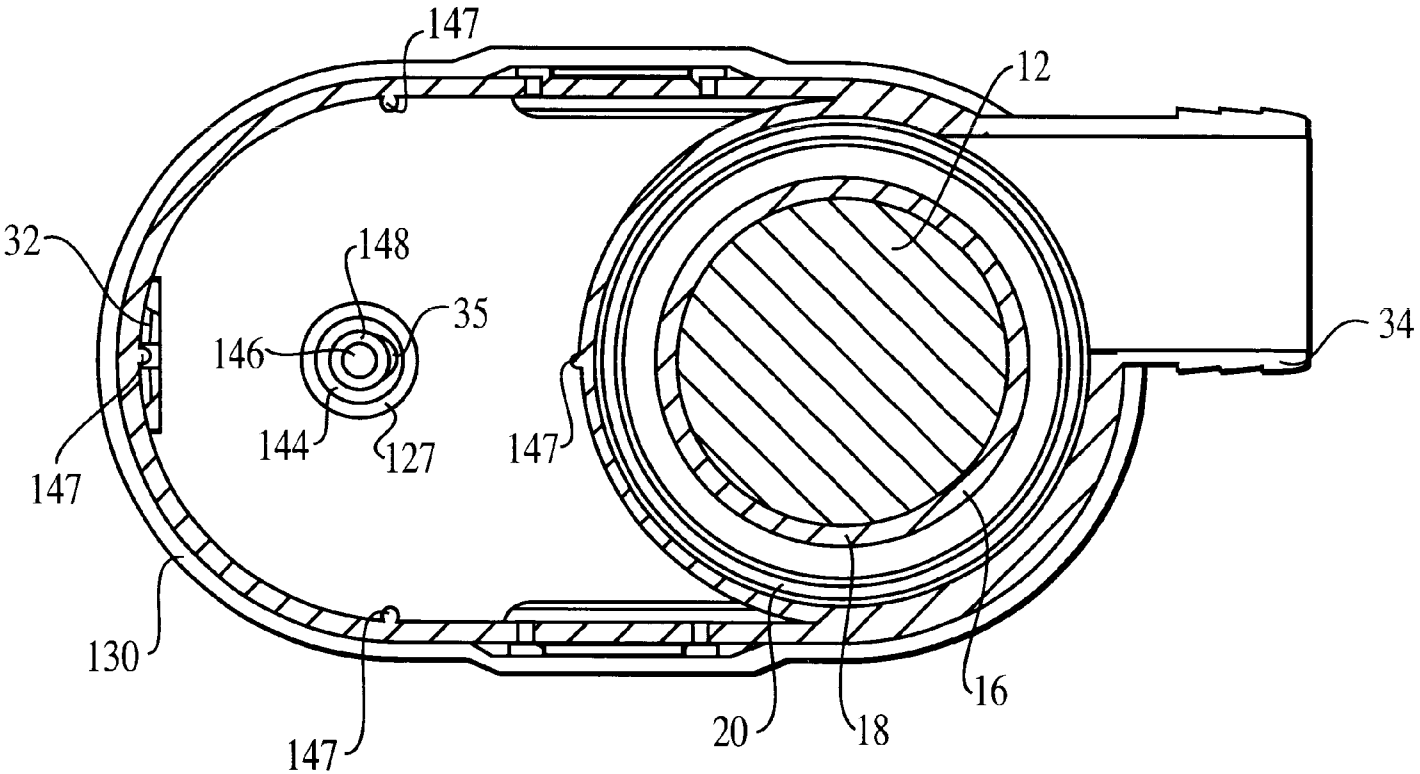
FIG. 13 is a cross-sectional view taken along line XIII—XIII of FIG. 12.

With reference to FIGS. 12–13, a bilge pump 110 constructed in accordance with a second preferred embodiment of the present invention is shown. It must be noted that the bilge pump 110 of this embodiment contains the same profile and is configured exactly the same as the bilge pump 10 of the first preferred embodiment with the major difference being the configuration of the float assembly 140 as described below. The same reference numerals will be used for like elements and functions.

The housing 130 is slightly modified as follows. The motor housing section 16 is further formed as a unit with a reed switch housing portion 152. A lower segment of the wall portion 31 is in physical connection with the nozzle case 22, which encircles the impeller 14. The nozzle case 22 extends to and is formed as a unit with a float compartment wall 125, which includes a magnet channel portion 127. The magnet channel portion 127 extends upwardly from the wall 125 and forms a magnet channel 144. Located at a lower portion of the nozzle case 22 in proximity to the impeller 14 is the opening 26 to allow liquid entering the strainer portion 32 to enter the nozzle case 22, so as to be acted upon by the impeller 14. The housing 130 is also modified by having the grommet 38 connected to and supported by the reed switch housing portion 152 through an opening 153.

The float compartment wall 125 is in physical connection with the outer housing portion 20, and together with the wall portion 31 form a float compartment 141. The float compartment 141 is in fluid connection with the strainer portion 32 through the magnet channel 144.

Next will be described the float compartment 141. The float assembly 140 is positioned within the compartment 141 and includes a float housing 148. The assembly 140 has a generally toroidal or doughnut-shaped cap and a leg 149 and has a roughly T-shaped cross-section. Encased within the float assembly 140 is a magnet 146. Preferably, the magnet 146 is positioned partially within the leg 149 of the float housing 148. The float assembly 140 is formed of materials suitable to make the assembly 140 as a whole less dense than water, such that it is able to float.

The float assembly 140 is positioned within the float compartment 141 such that the leg 149 extends into the magnet channel 144. The diameter of the leg 149 is smaller than the width of the channel 144, allowing relatively frictionless movement of the leg 149 within the channel 144. Further, the diameter of the cap of the float assembly 140 is smaller than the width of the compartment 141.

A plurality of guidance supports 147 extend vertically along the wall portion 31 and the inner housing portion 18. As shown in FIG. 13, four such supports 147 are positioned roughly ninety degrees (90°) apart. Other spacings and alignments of supports 147 may also be used. The supports 147 assist in aligning the float assembly 140 within the compartment 141 such that the leg 149 remains within the channel 144 as the water level within the compartment 141 repeatedly rises and falls.

As in the first preferred embodiment, the reed switch 42 is located vertically above the float assembly 140 and is affixed to the PCB 58. The PCB 58 is supported by the reed switch housing portion 152 which is contiguous with the motor housing section 16.

The float assembly 140 and the reed switch 42 co-act to engage the motor 12. As water enters the pump 110 through the openings 23, 35, the water level within the pump 110 rises into the channel 144. Since the float assembly 140 is less dense than water, the assembly 140 will float and will rise with the water. As the water level continues to rise, the magnet 146 moves closer to the reed switch 42. The magnet 146 will eventually move close enough to the reed switch 42 such that the switch 42 will co-act with the magnetic forces of the magnet 146, signaling through the PCB 58 the motor 12 to engage.

Figure 14:
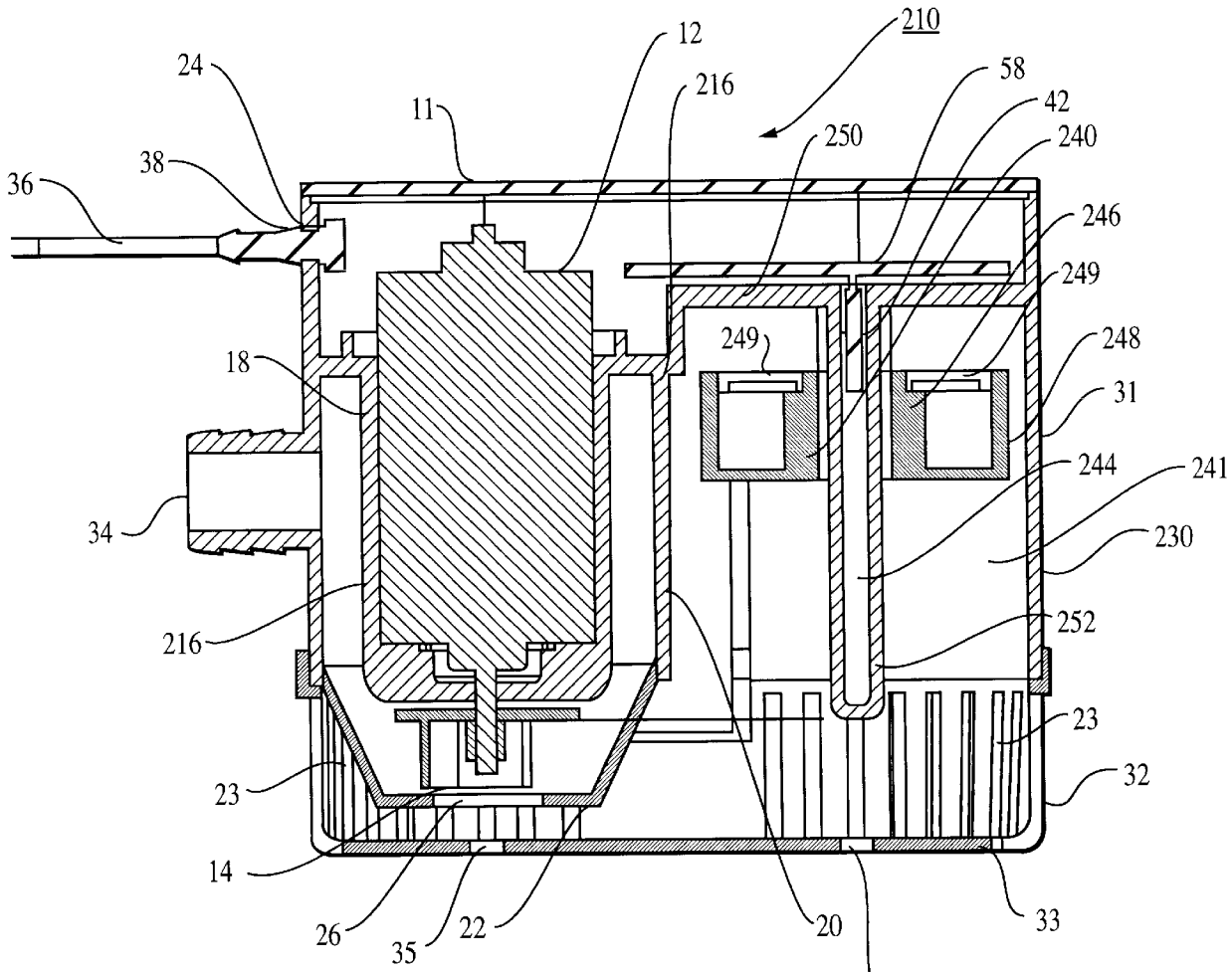
FIG. 14 is a view like FIG. 8 showing a second alternate float construction in accordance with the present invention.

It must be noted that the bilge pump 110 constructed in accordance with the second preferred embodiment of the present invention is deactivated in the same manner as the pump 10 constructed in accordance with the first preferred embodiment. It must also be noted that in either embodiment, the float assembly 40, 140 can be any suitable shape and is not limited to the shapes illustrated in the figures. In addition, it must be noted that the reed switch 42 does not have to reside on the PCB 58 itself. For example, as illustrated in FIG. 14, the reed switch 42 is positioned within a switch channel 244 formed within a reed switch housing 252. A float assembly 240 surrounds the channel 244, and as described in detail above in reference to the other embodiments, when the float assembly 240 rises with the water level, a magnet 246 affixed to the assembly 240 co-acts with the reed switch 42 to activate the pump motor 12.

With reference to FIG. 14, a bilge pump 210 constructed in accordance with a third preferred embodiment of the present invention is shown. It must be noted that the bilge pump 210 of this embodiment contains essentially the same profile and configuration as the bilge pump 10 of the first preferred embodiment with the major differences being that the discharge port 34 and the electrical connector 36 are on the same side of the pump housing 230 and that the configuration of the float assembly 240 has been changed as described below. The same reference numerals will be used for like elements and functions.

The housing 230 is modified as follows. The motor housing section 216 is further formed as a unit with a reed switch housing portion 252 which supports and partially encases the reed switch 42. The reed switch housing portion 252 includes a float compartment wall 250 extending from the motor housing section 216 which forms a switch channel portion 244 within the housing portion 252. In addition, the float compartment wall 250 is in physical connection with the outer housing portion 20, and together with the wall portion 31 form a float compartment 241.

Next will be described the float compartment 241. The float assembly 240 is positioned within the compartment 241 and includes a float housing 248. The assembly 240 is generally rectangular in shape, includes a top portion 249 and surrounds the switch channel 244. Encased within the float assembly 240 is a magnet 246. As with the previously described float assemblies, the float assembly 240 is formed of materials suitable to make the assembly 240 as a whole less dense than water, such that it is able to float.

The reed switch 42 is positioned within the channel 244 and is electrically connected to the PCB 58. The PCB 58 is supported by the float compartment wall 250.

The float assembly 240 and the reed switch 42 co-act to engage the motor 12. As water enters the pump 210 through the openings 23, 35, the water level within the pump 210 rises around the channel 244. Since the float assembly 240 is less dense than water, the assembly 240 will float and will rise with the water. As the water level continues to rise, the magnet 246 moves closer to the reed switch 42. The magnet 246 will eventually move close enough to the reed switch 42 such that the switch 42 will co-act with the magnetic forces of the magnet 246, signaling through the PCB 58 the motor 12 to engage.

It must be noted that the bilge pump 210 constructed in accordance with the third embodiment of the present invention is deactivated in the same manner as the pump 10 constructed in accordance with the first described embodiment.

Although the present invention has been described with reference to a bilge pump, it is apparent to one skilled in the art that the present invention can also be used as a sump pump and other similar type pumps.

While the invention has been described in detail in connection with preferred embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the spirited scope of the appended claims.

What is claimed as new and desired to be protected by Letters Patent of the United States is:

1. A pump comprising:

a pump housing including a first portion having a port and a second portion having a plurality of openings formed therein, said plurality of openings being adapted to allow liquid to enter said housing, said pump housing including a float compartment disposed therein;

a motor disposed within said housing, said motor adapted to cause the liquid present in said housing to be discharged through said port;

an activator electrically connected to said motor, said activator activating said motor when the liquid present in said housing reaches a first level, said activator comprising a float assembly within a float compartment and a position sensor switch in a location completely isolated from any liquid entering said pump housing, said switch being electrically connected to said motor, said float assembly using a first detection criteria to detect when the liquid reaches the first level to close said switch to activate said motor; and a deactivator electrically connected to said motor, said deactivator deactivating said motor when the liquid present in said housing reaches a second level, said deactivator using a second detection criteria to detect when the liquid reaches the second level, wherein said first detection criteria is different from said second detection criteria.

2. The pump of claim 1, wherein said deactivator comprises a sensor, said sensor deactivating said motor upon detecting a voltage of said motor indicative of said second level.

3. The pump of claim 1, wherein said float assembly comprises:

a float; and a magnet affixed to said float, said magnet adapted to close said position sensor switch when said float reaches said first level.

4. The pump of claim 3, wherein said position sensor switch is a reed switch.

5. The pump of claim 4, wherein said compartment is slightly larger than said float.

6. The pump of claim 5, wherein said float has a square shape.

7. The pump of claim 5, wherein said float has a toroidal shape.

8. The pump of claim 1, wherein said upper portion includes a plurality of closure tabs, each of said tabs having a closure lock, and wherein said lower portion includes a plurality of closure engagements, each of said engagements corresponding to a respective closure tab, said first portion being detachably connected to said second portion by inserting said locks into said engagements.

9. The pump of claim 8, wherein said housing has an elongated profile.

10. The pump of claim 1, wherein said position sensor switch is located above said float compartment.

11. The pump of claim 1, wherein said position sensor switch is located within a switch channel in said float compartment.

12. A pump comprising:

a pump housing, said housing including a first portion with a port formed therein and a second portion having a plurality of openings formed therein, said plurality of openings adapted to allow liquid to enter said housing;

a motor disposed within said housing, said motor causing liquid present in said housing to be discharged through said port when said motor is activated;

an activator electrically connected to said motor, said activator activating said motor when the liquid present in said housing reaches a first level, said activator comprising a float assembly within a float compartment and a position sensor switch in a location completely isolated from any liquid entering said pump housing, said switch being electrically connected to said motor, said float assembly being adapted to close said switch to activate said motor when the liquid in the housing has reached said first level; and a deactivator electrically connected to said motor, said deactivator deactivating said motor when the liquid present in said housing reaches a second level, said deactivator comprising a closed detector device.

13. The pump of claim 12, wherein said deactivator comprises a sensor, said sensor deactivating said motor upon detecting a voltage of said motor indicative of said second level.

14. The pump of claim 12, wherein said float assembly comprises:

a float; and a magnet affixed to said float, said magnet closing said position sensor switch when said float reaches the first level.

15. The pump of claim 14, wherein said position sensor switch is a reed switch.

16. The pump of claim 15, wherein said compartment is slightly larger than said float.

17. The pump of claim 16, wherein said float has a square shape.

18. The pump of claim 16, wherein said float has a toroidal shape.

19. The pump of claim 12, wherein said upper portion includes a plurality of closure tabs, each of said tabs having a closure lock, and said lower portion includes a plurality of closure engagements, each of said engagements corresponding to a respective closure tab, wherein said first portion is detachably connected to said second portion by inserting said locks into said engagements.

20. The pump of claim 19 wherein said housing has an elongated profile.

21. The pump of claim 12, wherein said position sensor switch is located above said float compartment.

22. The pump of claim 12, wherein said position sensor switch is located within a switch channel in said float compartment.

23. A bilge pump apparatus comprising:

pump housing means, said housing means including a first portion with a port formed therein and a second portion having a plurality of openings formed therein, said plurality of openings adapted to allow liquid to enter said housing means;

a motor disposed within said housing means, said motor having an impeller extending into said lower portion, said impeller adapted to cause the liquid to be discharged through said port when said motor is activated;

means for activating said motor when the liquid present in said housing means reaches a first level, said activating means comprising switch control means within a switch control means housing and a position sensor switch in a location completely isolated from any liquid entering said pump housing means, said position sensor switch being electrically connected to said motor, said switch control means using a first detection criteria to detect when the liquid reaches the first level to close said position sensor switch to activate said motor; and means for deactivating said motor when the liquid present in said housing means reaches a second level, said deactivating means using a second detection criteria to detect when the liquid reaches the second level, wherein said first detection criteria is different from said second detection criteria.

24. The apparatus of claim 23, wherein said deactivating means comprises voltage detection means for detecting a voltage of said motor indicative of said second level.

25. The apparatus of claim 23, wherein said switch control means comprises:

a float; and a magnet affixed to said float, said magnet closing said position sensor switch when said float reaches the first level.

26. The apparatus of claim 25, wherein said position sensor switch is a reed switch.

27. The apparatus of claim 26, wherein said compartment is slightly larger than said switch control means.

28. The apparatus of claim 27, wherein said float has a square shape.

29. The apparatus of claim 27, wherein said float has a toroidal shape.

30. The bilge pump apparatus of claim 23, wherein said position sensor switch is located above said switch control means housing.

31. The bilge pump apparatus of claim 23, wherein said position sensor switch is located within a switch channel in said switch control means housing.

32. A bilge pump comprising:

an upper portion, said upper portion having an open first side, said upper portion having a second side with a discharge port formed therein;

a straining portion, said straining portion having an open first side, said open first side of said straining portion being detachably connected to said open side of said upper portion to define a bilge pump housing, said straining portion having a plurality of openings formed therein, said openings allowing water to enter said bilge pump housing;

a motor housing disposed within said upper portion, said housing having an open first side;

a nozzle case disposed within said straining portion, said nozzle case having an open first side, said open first side of said nozzle case being coupled to said open first side of said motor housing, said nozzle case having a second side with an opening to allow water to enter said nozzle case;

a motor disposed within said motor housing, said motor having an impeller, said impeller extending into said nozzle case and causing water to be discharged through said discharge port when said motor is activated;

a float compartment disposed within said bilge pump housing, said compartment having a first surface including a plurality of vertically aligned guidance supports integrally formed therein, said compartment having a first side defined by a third side of said upper portion, said first side having an opening to allow water to enter said compartment;

a reed switch in a location completely isolated from any liquid entering said bilge pump housing and being electrically connected to said motor, said reed switch activating said motor when in a closed position;

a float assembly disposed within said guidance supports of said compartment, said assembly including a float and a magnet affixed to said float, said float rising with a level of the water entering said compartment, said magnet coming into close proximity of said reed switch, and thereby closing said reed switch, when the water in the compartment has reached a high water level; and a sensor electrically connected to said motor, said sensor deactivating said motor upon detecting a voltage of said motor indicative of a low water sensor.

33. The bilge pump of claim 32, wherein said position sensor switch is located above said float compartment.

34. The bilge pump of claim 32, wherein said position sensor switch is located within a switch channel in said float compartment.

35. A circuit for controlling a pump adapted to pump liquid when it reaches a first level, said circuit comprising:

an activation switch connected to a motor of the pump, said switch comprising a position sensor switch located above the first level and activating the motor when in a closed position;

an activation circuit generating an activation signal when the liquid reaches the first level;

a voltage sensor coupled to the motor;

a pump deactivation circuit coupled to said voltage sensor, said deactivation circuit detecting a voltage across said voltage sensor, said deactivation circuit generating a deactivation signal upon detecting a voltage indicative of a second level; and a trigger circuit coupled to said activation switch, said activation circuit and said deactivation circuit, said trigger circuit closing said activation switch responsive to said activation signal and opening said activation switch responsive to said deactivation signal.

36. The circuit of claim 35, wherein said voltage sensor is a resistor.

37. The circuit of claim 35, wherein said activation switch is a MOSFET transistor.

38. The circuit of claim 35, wherein said deactivation circuit includes a reference circuit, said reference circuit generating a reference voltage that is equal to a voltage indicative of the second level.

39. The circuit of claim 35, wherein said position sensor switch is a reed switch.

40. The circuit of claim 35, further comprising a power conditioning circuit to prevent over voltage conditions.

* * * * *